US005915734A

United States Patent [19]

Minehart

[11] Patent Number: 5,915,734

[45] Date of Patent: Jun. 29, 1999

[54] GREETING CARD AND SOUND RECORDING GIFT, DISPLAY AND SALE SYSTEM

[76] Inventor: Gary Minehart, Rte. 1, Box 158, Colton, Wash. 99113

[21] Appl. No.: 08/673,751

[22] Filed: Jun. 27, 1996

[51] Int. Cl.[6] ..... B42D 15/00

[52] U.S. Cl. ..... 283/117; 283/67

[58] Field of Search ..... 283/117, 56, 904, 283/94; 379/354, 355, 356, 357, 360; 40/124.1

[56] References Cited

U.S. PATENT DOCUMENTS

| | | |
|---|---|---|
| 1,502,312 | 7/1924 | Mayhew . |
| 2,225,048 | 12/1940 | Hasin . |
| 2,505,787 | 5/1950 | Munkacsi et al. . |
| 2,961,922 | 11/1960 | Schwartz et al. . |
| 3,063,338 | 11/1962 | Bregman . |
| 3,245,691 | 4/1966 | Gorman . |
| 3,529,832 | 9/1970 | Goetz et al. . |
| 4,124,943 | 11/1978 | Mitchell et al. . |
| 4,425,098 | 1/1984 | Doring . |
| 4,620,630 | 11/1986 | Moss . |
| 4,905,831 | 3/1990 | Bagdis et al. . |
| 4,907,826 | 3/1990 | Versage . |
| 4,993,560 | 2/1991 | Jaffe . |
| 4,996,681 | 2/1991 | Cocco et al. . |
| 5,016,241 | 5/1991 | Lee et al. . |
| 5,242,062 | 9/1993 | Engravalle . |
| 5,284,365 | 2/1994 | Stuart . |
| 5,318,327 | 6/1994 | Daneshvar . |

*Primary Examiner*—Willmon Fridie, Jr.
*Attorney, Agent, or Firm*—Wells, St.John, Roberts, Gregory & Matkin, P.S.

[57] ABSTRACT

A personalized, user assembled greeting card is described that includes a manually usable holder for detachably receiving a sound recording. The sound recording is user selected from a variety of available sound recordings, and is placed by the user in the holder for manual detachment by a recipient. A greeting card and sound recording display and dispenser system is also provided, with a first display section having card receptacles for releasably receiving and presenting a plurality of greeting cards for display and selection by a user. A second display section has sound recording receptacles for releasably receiving and presenting a plurality of sound recordings for selection by the user. A process is also described in which greeting cards and sound recordings are presented for user assembly in a combination to present a personalized greeting card and sound recording combination to a recipient. The steps include providing a selections of cards and sound recordings, in which the sound recordings are capable of being carried by the cards. The process further includes steps in selecting a sound recording, and combining the sound recording with the selected greeting card to produce a personalized greeting and sound recording combination.

14 Claims, 8 Drawing Sheets

14
43
HOMEWARD BOUND
44
26
22
24
33
31
28
30
29
40
43
25
53
CAN'T WAIT TILL I'M BACK
49
HOMEWARD BOUND
14
39
40
38
39
48
48
13
34
35
31
46
49
47
40

22
12
24
26
33
38
40
31
28
29
30
53
49
50
CAN'T WAIT TILL I'M BACK
47
48
42
13
34
48
49
35
31
35
33
24
50
48
49
31
53
CAN'T
WAIT
30
47
46
13
50
35
48
26
34
40
50
50
49
35
34
39

Fig 5
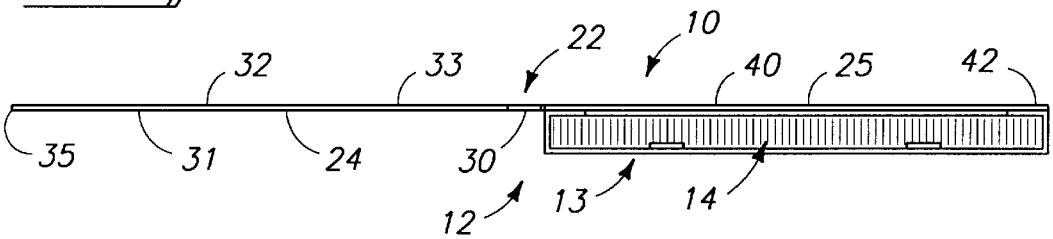
Fig 6
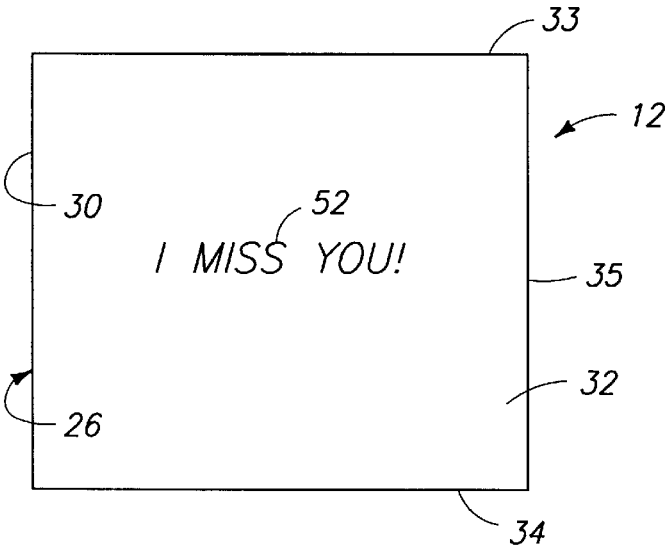
Fig 7
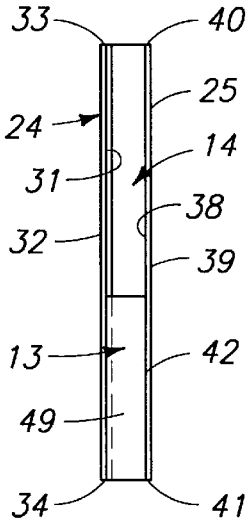
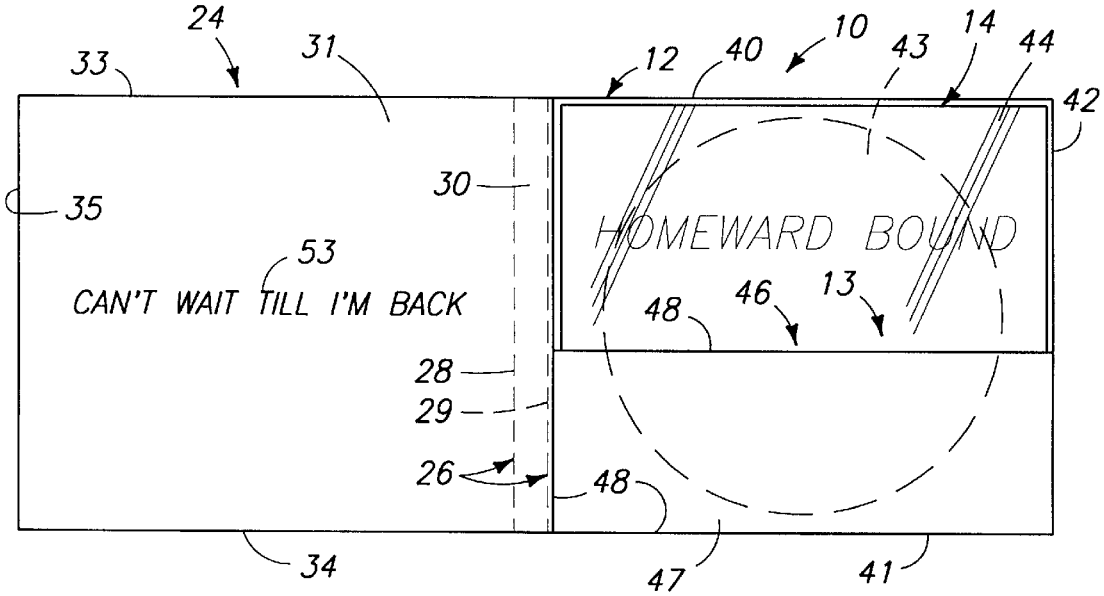
Fig 8

Fig 9
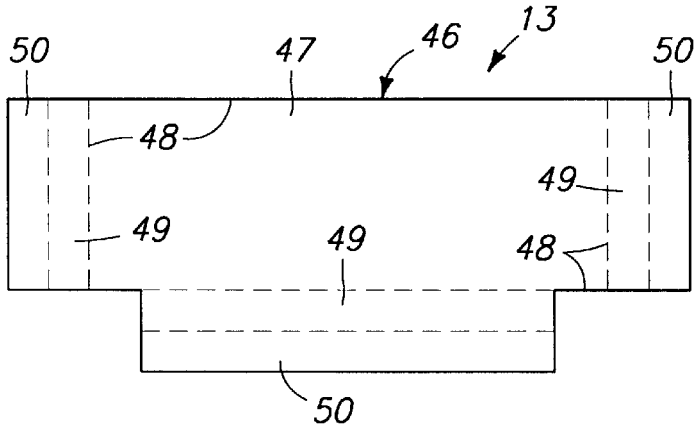
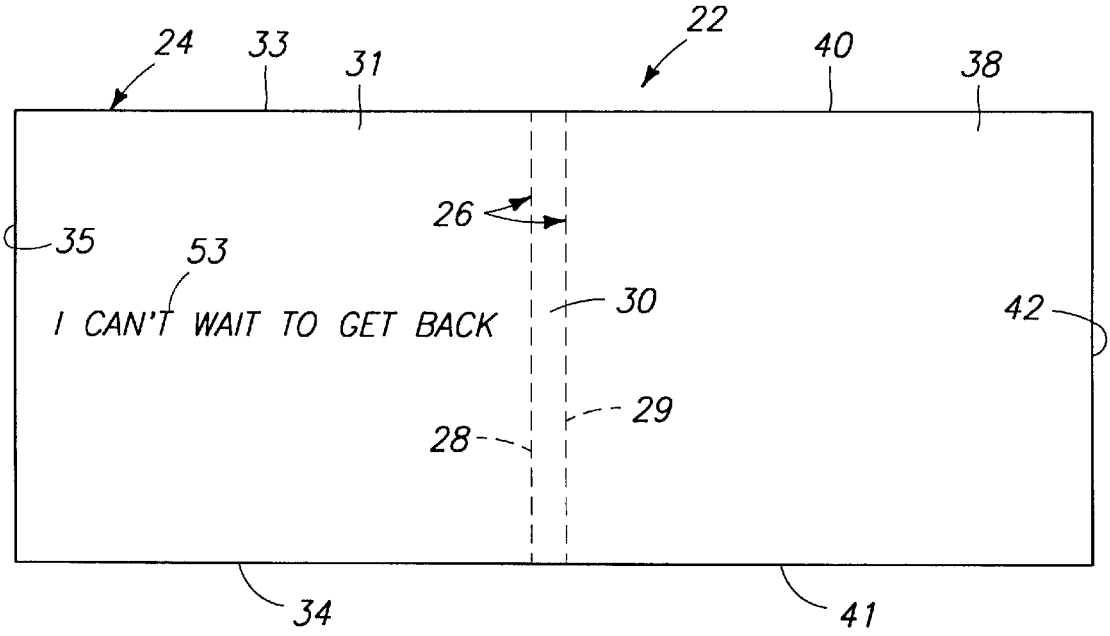
Fig 10

GREETING CARD AND SOUND RECORDING GIFT, DISPLAY AND SALE SYSTEM

TECHNICAL FIELD

The present invention relates to personalized greeting and gift selection, and more particularly to a system and product in which an individual is allowed to personally select and combine individual greeting cards and sound recordings.

BACKGROUND OF THE INVENTION

The greeting card market exists to provide an avenue for individuals to express various emotions to others. Cards themselves do not typically present the recipient with more than a written message, and as such can fall short of the giver's intended expression.

Music is another well recognized mode for expression of feeling and emotion. Previously, music has not been well utilized in combination with greeting cards. Greeting cards have been produced in the past with various musical greetings, using small pre-programmed electronic units built into the card bodies. The music afforded by the small electronic units is more of a novelty feature, is of low sound quality and of little value from a gift standpoint.

With the above novelty cards, the card purchaser has little or no choice of music and verse. The items are rare and selection is not provided in most situations. No provision has been previously made to give the purchaser a choice of different card verses with different songs.

SUMMARY

The present invention provides a novel and greatly improved solution to the common purchasing problem of purchasing a greeting card which is appropriate and meaningful. With the invention, the purchaser has independent control over selection of both the greeting card and sound recording. The purchaser thus has the ability to personalize the resulting greeting card and simultaneously present a gift in the form of a sound recording which synergistically conveys a personal message and greater degree of emotional response to the recipient.

The present invention also provides a novel and dynamic way of marketing two items as one product. The retailer is able to display the greeting cards and sound recordings separately and in such a manner that the customer may select a card from a number of different available cards, and independently select a sound recording from a selection of different sound recordings. The user can then assemble the combination which is sold as a single unit. The resulting gift has a dramatic effect with regard to both the person giving the gift and greater meaning and utility to the recipient.

BRIEF DESCRIPTION OF THE DRAWINGS

Preferred embodiments of the invention are described below with reference to the following accompanying drawings.

FIG. 5 is a top view of the preferred card with a sound recording, and showing the card in an open condition;

FIG. 6 is a frontal elevation view of the preferred card in a closed condition;

FIG. 7 is an end elevation view of the preferred card with a sound recording, and showing the card in a closed condition;

FIG. 8 is a frontal elevation view of the preferred card in an open condition;

FIG. 9 is flat pattern view of a preferred sound recording holder portion of the greeting card;

FIG. 10 is a view similar to FIG. 8 showing only the preferred card body without the sound recording holder portion;

DETAILED DESCRIPTION OF THE PREFERRED EMBODIMENTS

Figure 1:
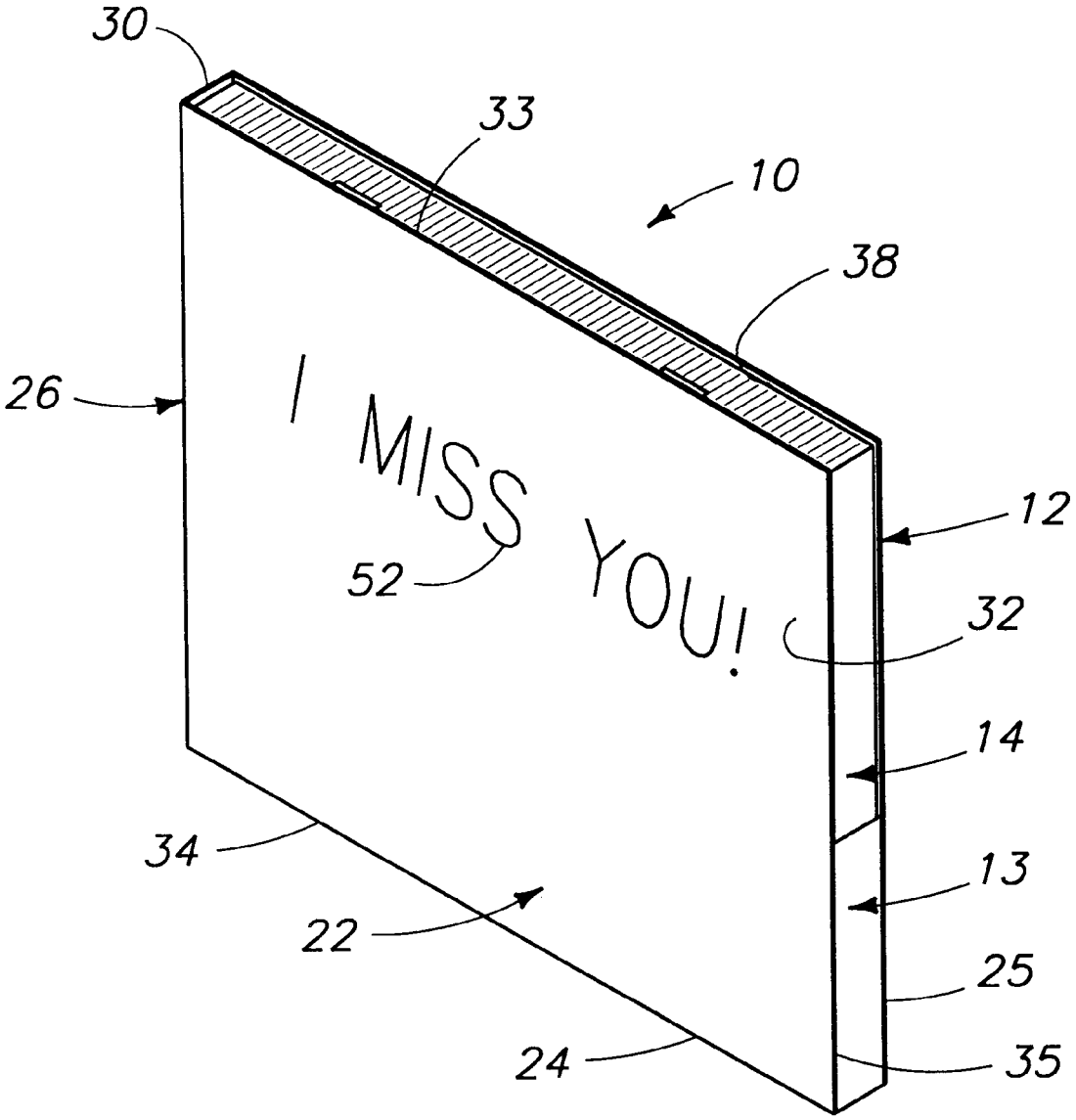
FIG. 1 is a perspective view exemplifying a first preferred form of the present greeting card with a sound recording combined therewith by a user.

This disclosure of the invention is submitted in furtherance of the constitutional purposes of the U.S. Patent Laws "to promote the progress of science and useful arts" (Article 1, Section 8).

A first preferred form of the invention, generally includes a personalized greeting card-sound recording assembly 10 according to the invention. The assembly 10 includes a greeting card and recording holder 12 for detachably receiving a sound recording unit 14. The sound recording unit is selected by a greeting card giver from a variety of available sound recordings. The sound recording unit is held within a portion of the card, specifically at holder section 13. Holder section 13 serves by holding the selected sound recording for manual detachment by a recipient of the card 12. In one form, card 12 is provided without a sound recording. In another form, the card and sound recording are user assembled as a combination. The card and sound recording unit can also be assembled by store personnel, if desired.

Figure 12:
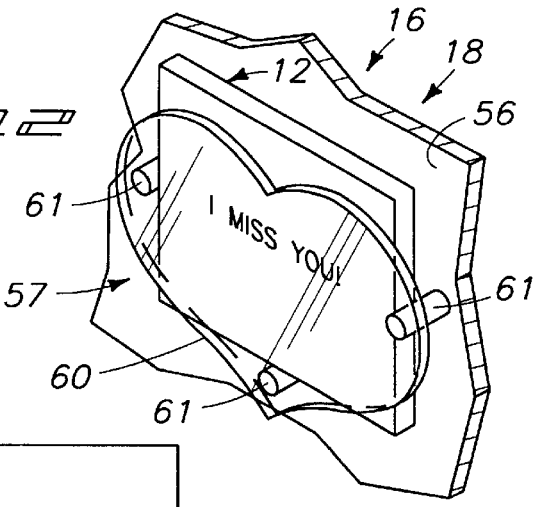
FIG. 12 is a fragmented perspective view of an exemplary receptacle for displaying a card, showing a card mounted therein.
Figure 13:
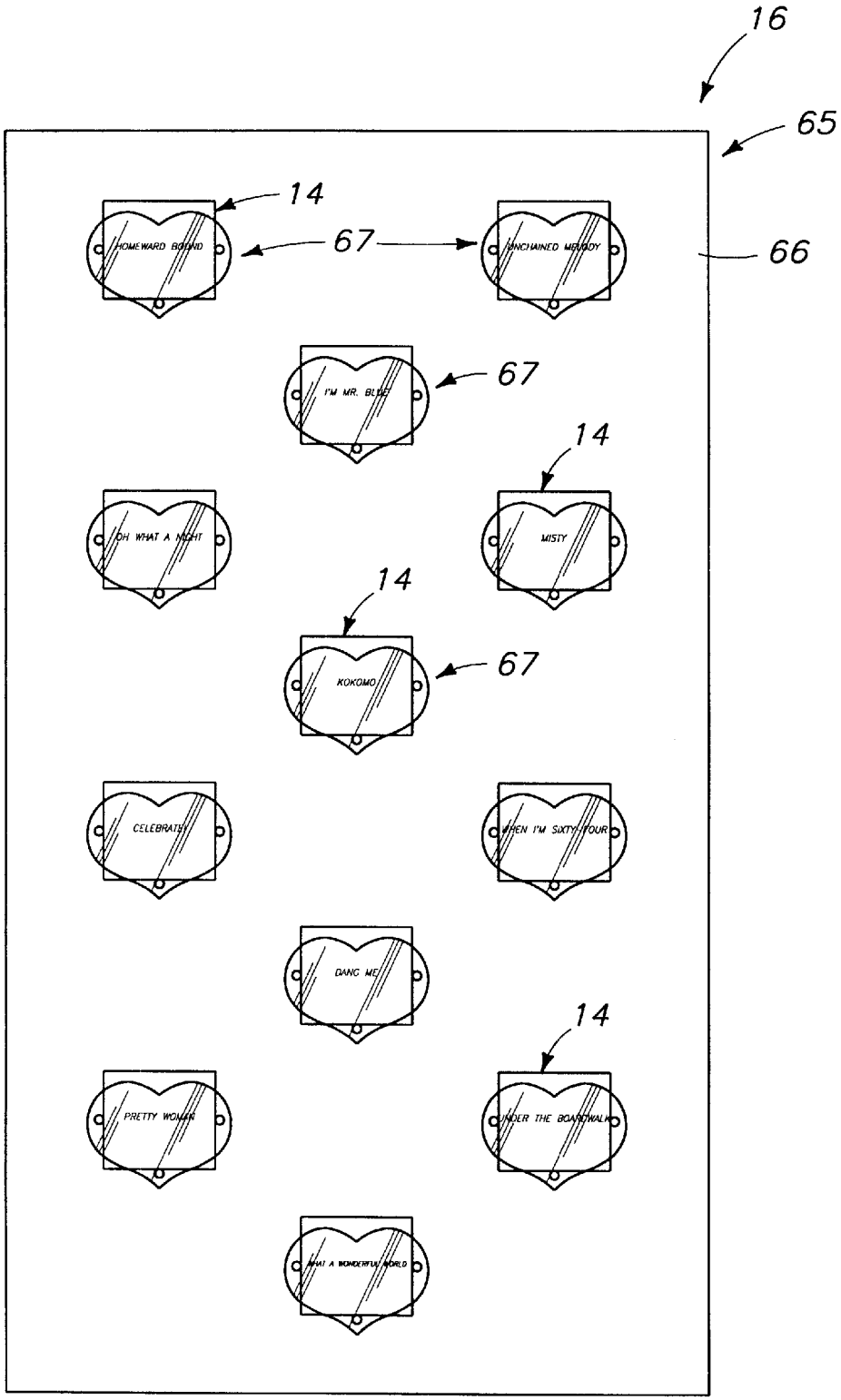
FIG. 13 is a frontal elevation view of a preferred display and dispenser for sound recordings.

The cards 12 and sound recordings 14 are user assembled through provision of a novel greeting card and sound recording display and dispensing system 16 shown in FIGS. 12 and 13. Display and dispensing system 16 includes a first display and dispenser part 18 which is provided for cards 12. It further includes a second display and dispenser part 20 for sound recordings 14.

In an alternate form, the display and dispenser 18 for cards 12 may be provided or used alone, without sound recording selections to enable the purchaser to select a sound recording from another source for combination and presentation with the selected card as an assembly.

The present invention also includes a process for assembling the greeting card 12 with a sound recording 14. The process steps and details of the embodiments presented in a general manner above will be described in greater detail below.

Details of a preferred form of greeting card according to the invention are illustrated in the form of card 12 shown in FIGS. 1–10.

Figures 3, 4:
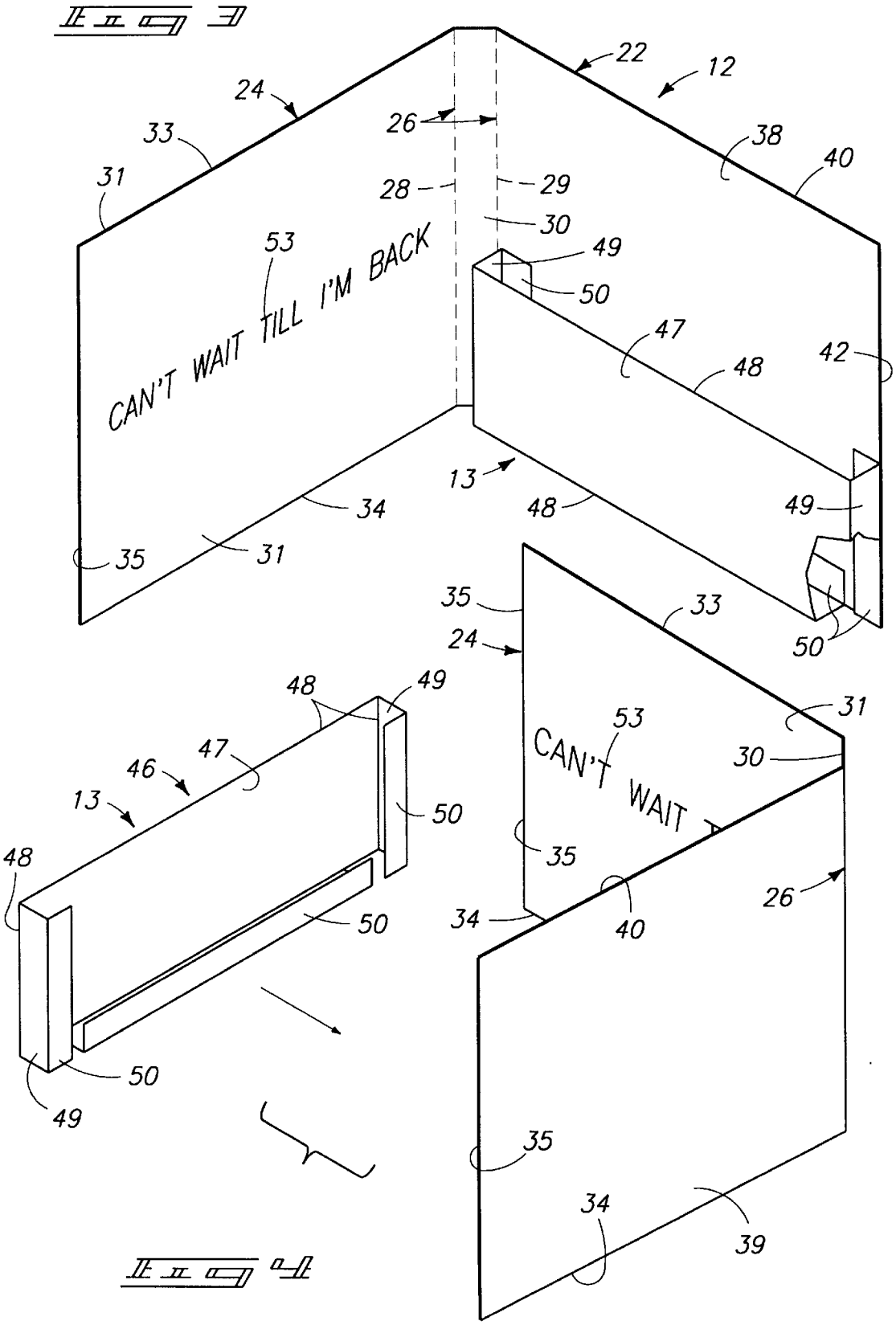
FIG. 3 is a perspective view of a preferred card without a sound recording.
FIG. 4 is an exploded perspective view showing a card body and a sound recording holder removed therefrom.

FIG. 3 shows greeting card 12 is formed of a card body 22. The card body 22 may be formed of conventional paper greeting card stock. The card body preferably includes a cover section 24, and an opposed back section 25. A fold or set of folds 26 divides the card body, separating the cover and back sections.

In the preferred form, the fold or spline section 26 of the card includes a pair of substantially parallel fold lines 28, 29 extending across the card body 22 adjacent the sound recording holder 13. Fold lines 28, 29 are formed as creases in the card body, functioning as integral hinges about which the cover and back sections 24, 25 will fold. A spline 30 is defined between the lines 28, 29.

The fold lines 28, 29 are advantageously spaced apart by a distance sufficient to permit the card cover and back sections 24, 26 to be folded over the holder 13 and a sound recording 14 held therein. The card 12 will thus fold between an open condition, such as shown in FIGS. 3, 5, and 8; and a closed condition as shown in FIGS. 1, 6 and 7.

In the preferred card body 22, the cover section 24 includes an inside cover face surface and an opposed outside cover face surface 32. The opposed surfaces are bordered by top and bottom edges 33, 34, a cover distal or leading edge 35, and fold line 28.

Similarly, the back section 25 includes an inside back surface 38 and an opposed outside back surface 39. These surfaces are bounded by top and bottom edges 40, 41, a back distal or leading edge 42, and fold line 29. In the construction shown, the top edge 40 preferably lies in the same plane as the cover top edge 33, although other configurations are possible. Likewise, the bottom edges 34, 41 are coplanar, and are parallel to the top edges. The leading edges 35, 42 are preferably perpendicular to and join the top and bottom edges, and are parallel to the fold lines 28, 29.

The distance between top edges 33, 40 and bottom edges 34, 41 is selected to be slightly greater than one side dimension of a sound recording case. The distances between respective leading edges 35, 41 and fold lines 28, 29 are likewise selected to be slightly greater than another side dimension of a sound recording. The front and back leaves may thus span and visibly cover all or part of a sound recording 14 when the recording is held within the holder section 13 and the card is in the closed condition as shown in FIG. 1.

Figure 2:
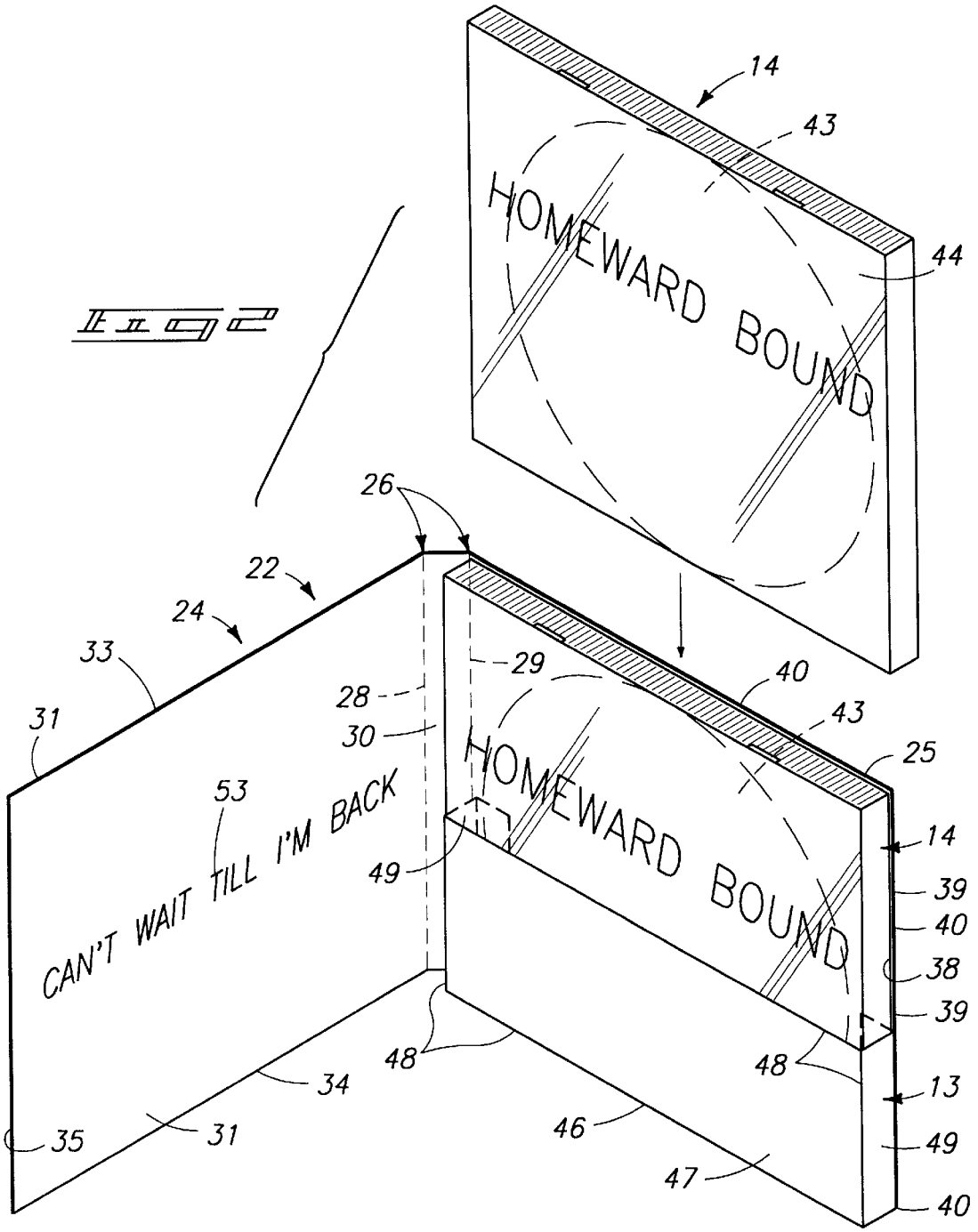
FIG. 2 is a perspective exploded view of the card shown in FIG. 1 with the card open and showing the user selected sound recording.

It should be understood that the above configuration is preferred for particular sound recordings, and that dimensions may be varied to accommodate sound recordings of different dimensions. For example, the sound recording may be an audio compact disc (CD) sound recording 43 in a typical protective case 44 (FIG. 2). CD cases typically measure approximately 4⅞ inches by 5½ inches. Card bodies produced to contain CDs and their commonly used clear plastic protective cases will thus have similar but slightly greater dimensions in order to visually cover the case and provide a wrapping or enclosure for the sound recording.

In another example, the sound recording may be a standard audio tape cassette in a typical protective case (not shown). Such cases measure approximately 2¾ inches by 4¼ inches and will require cards with cover and back sections having dimensions slightly larger than the cassette case.

The width dimensions of the spline between the fold lines 28, 29 will similarly vary according to the thickness of the sound recording. Other aspects of construction may also affect the particular sizes of units used.

With the above constructions, the nature of the contents (the sound recording) between the closed cover and back sections may be hidden from initial viewing by the card recipient until the card is opened. This provides individuals an opportunity to substantially personalize the character of the card and presentation to the recipient. In addition to the personal card selection, the user is allowed to personally select and combine the card with an individually selected sound recording. The cover and back sections can add an element of surprise for the recipient who will open the card to discover not only a message, but the personally selected sound recording.

The holder 13, shown in detail in FIGS. 3, 4, and 9, includes a sound recording receiving pocket 46 releasably receiving, supporting and mounting the sound recording. The card 12 can be produced with the holder 13 on any one of the card body surfaces 31, 32, 38, or 39. In the preferred embodiment shown, the holder is positioned on the inside back surface 38. This is done to leave the inside face surface 31 and outside face surface 32 of the cover for appropriate indicia (described below).

The preferred holder 13 overlaps only part of the surface area occupied by the inside back surface 38. Thus part of the received sound recording will be visible and uncovered by the sound recording pocket 46.

The pocket 46 can be formed by a pocket part or assembly. In a preferred form of the invention, it is constructed so as to include a flat panel 47 with peripheral edges 48. Flanges 49 project from some of the edges 48 and include glue tabs 50 that are attached to the card body. The flanges 49 space the panel 47 from the card body by a distance sufficient to enable the sound recording to be releasably received between the pocket panel 47 and adjacent portions of the card body.

The holder and card body may be formed of dissimilar materials, or more preferably of the same material, such as paper greeting card stock. It can be suitably attached by a variety of conventional adhesives to the card body. Other attachment techniques may also be used, such as mechanical features of the pocket and/or card body which mechanically engage.

As shown in FIGS. 4 and 9, the pocket assembly has three flanges 49 and three glue tabs 50, one at the bottom and one at each side of main panel 47. When attached to the card body, the flanges provide vertical and lateral support for the sound recording. The panel 47 holds the sound recording close against the adjacent surface 38.

Figure 14:
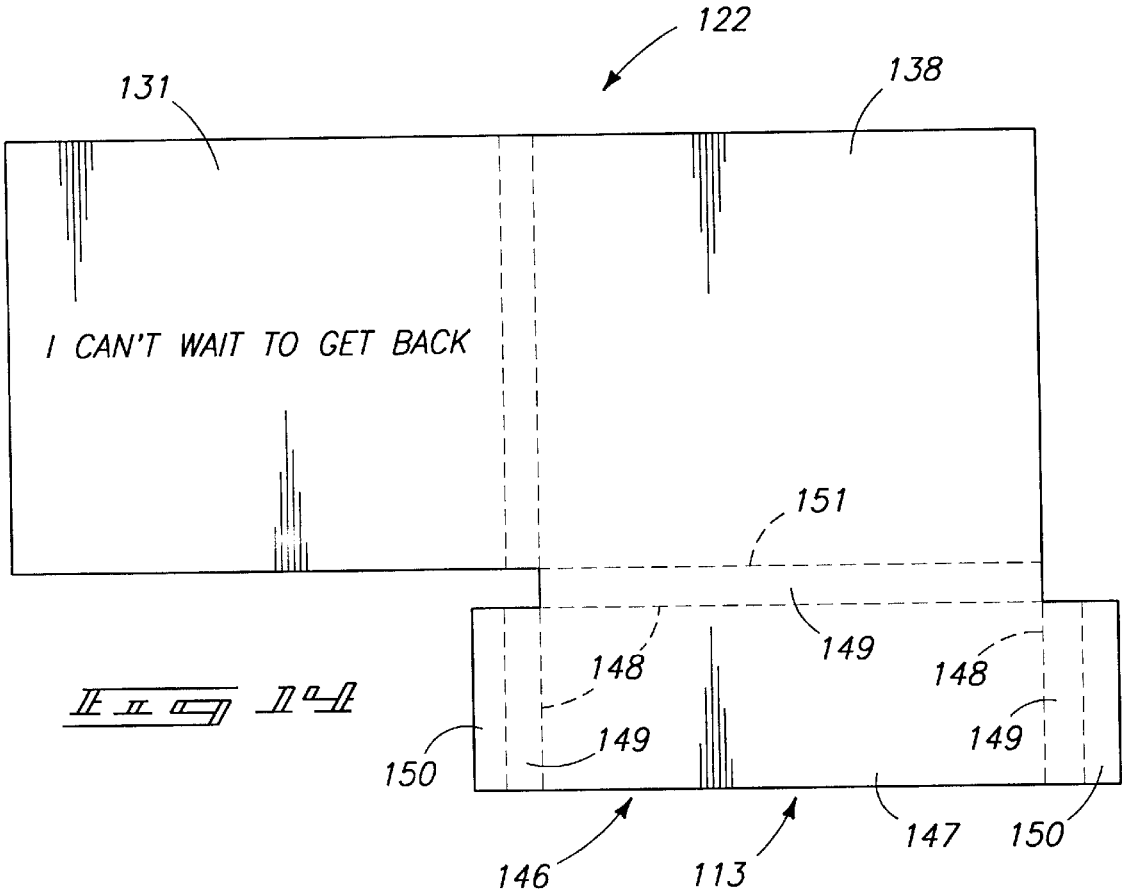
FIG. 14 is a flat pattern view of an alternate embodiment of the greeting card body with an integrated holder.
Figure 15:
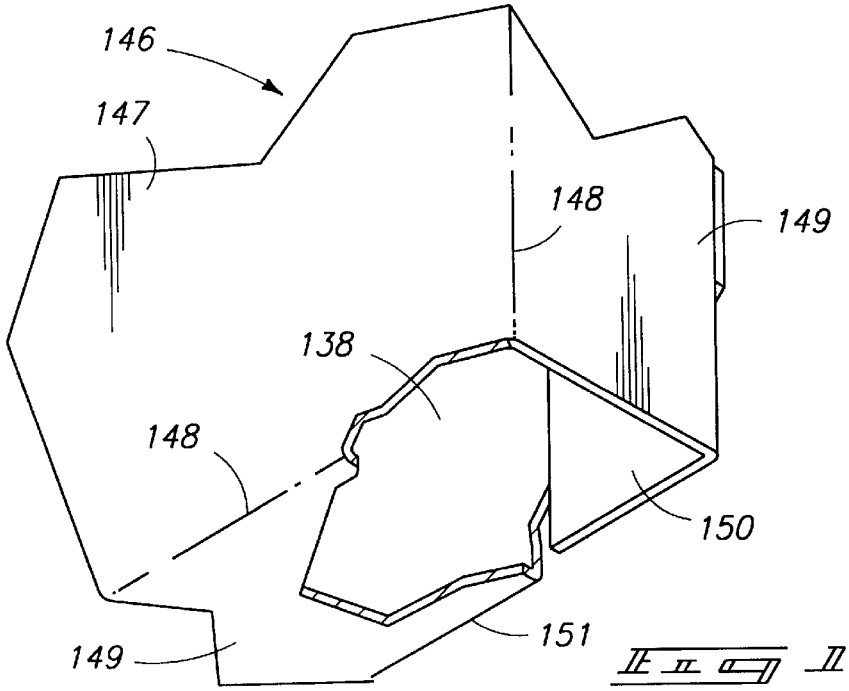
FIG. 15 is a fragmented perspective view of the holder for the alternate embodiment.

It should also be noted that the configuration of the holder may vary from the preferred construction shown in the drawings. For example, alternate forms of the holder as shown in FIGS. 14 and 15 may be formed integrally with the card body, and folded into substantially the same configuration shown. The holder may also take forms other than the rectangular configuration shown. For example, the CD disk 43 can be provided without protective case 44 and a thinner pocket would be used. It is necessary only that the holder 13 be connected to the card body and arranged in some manner thereon to enable the user to attach a sound recording 14 in a desired position.

In the embodiment illustrated in FIGS. 14 and 15, a card body 122 includes an integral holder 113, forming a sound recording receiving pocket 146 for releasably receiving, supporting and mounting the sound recording. The card can be produced with the holder 113 on either of the card body surfaces 131 or 138. In the embodiment shown, the holder 113 is integrated with the inside back surface 138. This is done to leave the inside face surface 131 and the opposed outside face surface of the cover for indicia.

The holder 113 overlaps only part of the surface area occupied by the inside back surface 138. Thus a part of the received sound recording will be visible and uncovered by the sound recording pocket 146.

The pocket 146 can also be formed by a pocket part or assembly. In the embodiment exemplified in FIGS. 14, 15, the pocket 146 is constructed so as to include a flat panel 147 with three peripheral edges 148, and is integrally joined to the back surface 138 along a fold line 151. In the example shown (FIG. 14), two of the three flanges 149 project from the edges 148 at ends of the panel 147, and include glue tabs 150 that are attached to the card body. All three flanges 149 space the panel 147 from the card body by a distance sufficient to enable the sound recording to be releasably received between the panel 147 and adjacent portions of the card body.

The glue tabs 150 can be suitably folded as shown graphically in FIG. 15, and may attached by a variety of conventional adhesives to the card body. Other attachment techniques may also be used, such as mechanical features of the pocket and/or card body which mechanically engage.

As shown in FIG. 14 the pocket assembly has three flanges 149 and two glue tabs 150, one at each side of main panel 147. When attached to the card body, the flanges 149 provide vertical and lateral support for the sound recording. The panel 147 holds the sound recording close against the adjacent surface 138.

As explained above, indicia is provided on the card body to serve the greeting card function. More specifically, greeting indicia 52 is provided on one of the surfaces, preferably the outside face surface 32. Message indicia 53 is situated on a prescribed one of the remaining surfaces or the panel 47, but preferably on at least the inside cover face surface 31. All other surfaces of the card 12 may also or alternatively be used to carry words, designs or other decorative or greeting items.

The nature of the greeting indicia 52, and the message indicia 53 may vary according to the desires of the card producer. The indicia may take any appropriate form, including written script, but may also be simply graphic imagery, or a combination of both to express a particular mood or occasion the user wishes to convey.

In a preferred form, indicia 52 will lend itself to a selection of one or more suitable sound recordings 14 which may be combined therewith. The result of the combination of a card with selected indicia, and a selected sound recording is a personalized greeting gift unlike any heretofore available by using conventional greeting cards or sound recordings separately. This combined effect is even further accentuated for both purchaser and recipient by the ability to customize the card with a particular sound recording.

Figure 11:
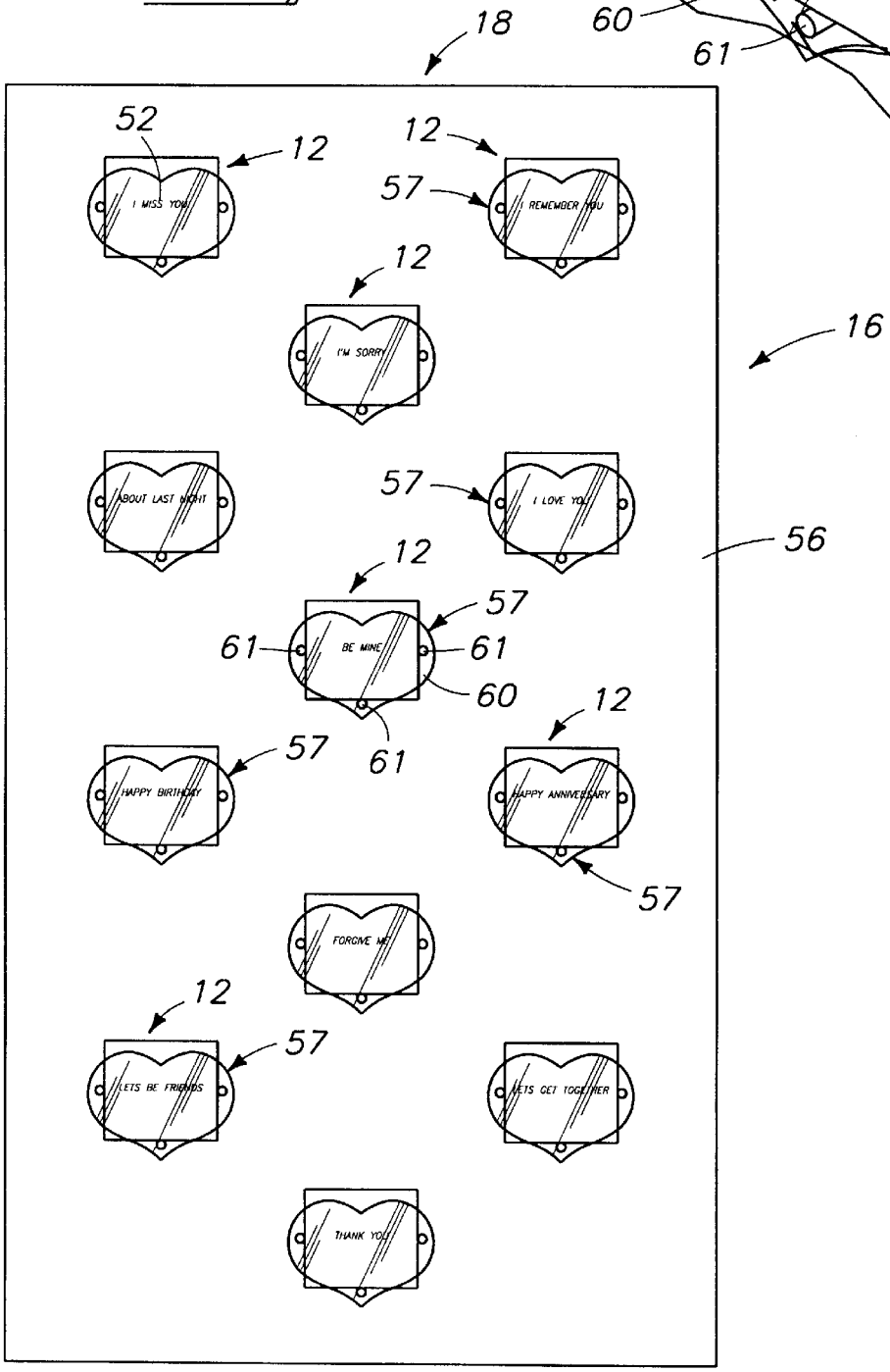
FIG. 11 is a frontal elevation view of a preferred display and dispenser for displaying the preferred cards for sale.

The invention also includes a display and dispensing system 16 which makes the customized assembly of a particular greeting card and sound recording conveniently possible. A preferred form for the display and dispensing system 16 is shown in FIGS. 11–13.

In a first preferred form, the display and dispensing system includes a first display 18 which dispenses user assemblable greeting cards 12. Cards 12 being adapted for reception of sound recordings 14. Display 18 is shown in detail in FIGS. 11 and 12.

The preferred first display 18 includes a plurality cards 12 as described above, held using an array of card supports. The card supports are constructed such that each card may be individually viewed. It is preferred that the individual cards be presented in a closed condition, and without sound recordings placed within their individual holders. This facilitates the purchaser's customizing. It also allows the novel cards to be individually purchased.

First display 18 includes a display panel or board 56, formed of a rigid material such as wood, plastic, press board, cardboard or the like. In the preferred form shown, the panel is rectangular. However, other panel configurations can be used, depending on the desired size of the display, and distributor space requirements. Other display dispensers are also possible. An alternative display dispenser could include a rotary, floor mounted rack (not shown).

Card receptacles 57 serve as card supports and are provided on panel 56. Receptacles 57 releasably receive and present the cards 12 in a visual display and within manual reach. The receptacles 57 are arranged on the panel 56 in such a manner that any one of the cards 12 may be selected by the purchaser and manually combined with a selected sound recording. The purchaser places the selected sound recording in the holder of the selected card, to thereby present a personalized, user assembled greeting card and sound recording combination.

The receptacles 57 exemplified in FIGS. 11 and 12 are produced by heart shaped retainer plates 60. Other shapes can of course be used. In preferred forms, the retainer plates 60 are transparent to allow full visual exposure of the cards 12 held thereby. Retainer plates 60 are spaced from the surface of the display panel 56 by dowels or other spacers 61. The drawings show three spacers 61 for each receptacle, one at the bottom center for supporting a card 12, and two at opposed sides for laterally stabilizing the card.

The support spacers 61 hold the associated plates 60 a sufficient distance from the panel 56 to receive at least one card 12. Greater spacing may be used where several identical cards are to be received in each receptacle 57 for inventory and stocking purposes.

It is noted that the first display 18 may be provided alone or in multiples, allowing the user a selection of cards 12 to be combined with sound recordings purchased from another source. However, it is more preferred to complete the system 16 by including one or more second display dispensers 20, for holding, displaying and dispensing sound recordings 14, in combination with the first display or displays 18.

An exemplary sound recording display is shown by FIG. 13. Here a panel 66 is used, with sound recording support receptacles 67 thereon releasably receiving and presenting the sound recordings 14 for visual display. The receptacles 67 or other supports are arranged in such a manner relative to the first display 18 that one of the cards 12 and one of the sound recordings 14 may be selected by a user and manually combined by the user. The selected sound recording can be placed in the holder 13 of the selected card 12 to thereby present a personalized, user assembled greeting card and sound recording combination.

In the preferred form shown, the second display 20 is similar to the first display 18. In fact, it may be identical to or even integral with the first display 18, since the sound recordings 14 are of similar size to the cards 12. Further description of the second display 20 is therefore unnecessary. The sound recordings received within the receptacles 67 will be clearly visible and manually accessible to the user as are the cards 12 in the first display 18. In the most preferred system, the first and second displays are separated so that a card can be selected at a first station or area, and a recording can be selected at a second station or area. Alternatively, the recording and cards can be selected in reverse order.

The presently preferred process for dispensing greeting cards 12 and sound recordings 14 for user assembly includes the following steps.

As a first step, a selection of greeting cards 12 is provided. This can be accomplished at the point of sale by a merchandiser. Preferably the selection of cards is arranged for visual observation by prospective purchasers using a suitable display and dispensing system, such as described above. Numerous greetings and messages can be provided on the various cards 12 in the selection, to offer the user a choice.

In another step a selection of sound recordings 14 is provided, each being capable of being carried by a selected one of the greeting cards and capable of user assembly with the greeting cards. This again may be accomplished by the merchandiser. It is most advantageous that the selection of sound recordings be displayed as described above, and in close proximity to the card display. Numerous different sound recordings are preferred in the selection to again offer the user variety of choice.

Another step involves selecting a greeting card from the selection of greeting cards 12. This step is advantageously accomplished by the user or card purchaser. The selection is made by viewing the various cards 12, and the greeting indicia on the cover sections 24. If a particular greeting appears to be pertinent, the user can remove the card from its receptacle and open it to view the message 53 on the inside.

A still further step is that of selecting an appropriate sound recording 14 from the selection of sound recordings. Preferably the sound recording selection will be displayed in an area adjacent to the card selection display. The user may simply view the various displayed sound recordings and pick one that is most pertinent to the sentiment to be expressed.

The user may now complete the step of combining the selected sound recording with the selected greeting card, thereby producing a personalized greeting card and sound recording combination. The combination may be packaged in an appropriate envelope (not shown) of standard or various constructions for mailing, hand delivery or other delivery to the recipient.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A personalized, user assembled greeting card and sound recording, comprising:

a user selected card body including opposed outside and inside surfaces, and divided by at least one fold into a cover section and a back section;

greeting card indicia on the card body;

a sound recording holder on the card body; and a sound recording selected independently of the card body, and user positioned for support by the sound recording holder wherein:

the cover section includes inside and outside cover face surfaces;

the back section includes inside and outside back face surfaces;

the holder includes a sound recording receiving pocket releasably receiving and mounting the sound recording against on one of the inside cover, inside back, or outside back face surfaces and overlapping part of the surface area occupied by the one face surface such that part of the sound recording is visible and uncovered by the sound recording pocket;

greeting indicia on the outside cover face surface; and message indicia on a prescribed one of the inside cover face surface, inside back face surface, or pocket.

2. A display and dispenser of user assemblable greeting cards with holders for reception of sound recordings, comprising:

a plurality cards, each including a card body including a cover section, a back section, and a fold separating the cover and back sections;

said plurality of cards including sound recording holders on each of the card body sections for releasably receiving and mounting a user selected sound recording;

a card display having card receptacles thereon releasably receiving and presenting the cards in a visual display and arranged in such a manner that one of the cards may be selected by the user and manually combined by the user with the user selected sound recording being received by the holder to thereby present a personalized, user assembled greeting card and sound recording combination.

3. A display and dispenser of user assemblable greeting cards with holders for reception of sound recordings, as claimed by claim 2, further comprising:

a sound recording display and dispenser with receptacles for releasably receiving and visually displaying a plurality of sound recordings; and a plurality of sound recordings releasably received by the receptacles for user selection.

4. A display and dispenser of user assemblable greeting cards with holders for reception of sound recordings, as claimed by claim 2, further comprising:

a sound recording display and dispenser with receptacles for releasably receiving and visually displaying a plurality of sound recordings; and a plurality of sound recordings releasably received by the receptacles for user selection;

wherein the card and sound recording displays are adjacent one another and present the cards and sound recordings for independent visual inspection and selection so any one of the cards can be combined with any one of the sound recordings.

5. A display and dispenser of user assemblable greeting cards with holders for reception of sound recordings, as claimed by claim 2, wherein each holder is comprised of:

a sound recording receiving pocket including a flat panel with peripheral edge surfaces and having flanges on some of the edge surfaces attached to the card body and spacing the panel from the card body by a distance to enable the sound recording to be releasably received between the panel and card body.

6. A display and dispenser of user assemblable greeting cards with holders for reception of sound recordings, as claimed by claim 2, wherein each holder is integrated with an associated card body and is comprised of:

a sound recording receiving pocket including a flat panel with peripheral edge surfaces and having flanges on some of the edge surfaces attached to the card body and spacing the panel from the card body by a distance to enable the sound recording to be releasably received between the panel and card body.

7. A greeting card and sound recording display, comprising:

a first display section having card receptacles thereon, each for releasably receiving and presenting a plurality of greeting cards card for display and selection by a card giver;

a second display section having sound recording receptacles thereon for releasably receiving and presenting a plurality of sound recordings for display and selection by the card giver;

whereby the user can select a desired greeting card from the plurality of greeting cards, and can also independently select a desired sound recording from the plurality of sound recordings to thereby create a personalized greeting card-sound recording combination.

8. A greeting card and sound recording display as claimed by claim 7 wherein the first and second display sections are positioned adjacent one another with the card and sound recording receptacles facing in one direction for visually displaying cards and sound recordings to the user.

9. A personalized, user assembled greeting card including:

a manually usable holder for detachably receiving a sound recording selected by a card giver from a variety of available sound recordings, and for holding the selected sound recording for manual detachment by a recipient of the personalized, user assembled greeting card a card body including cover and back sections, and a fold separating the cover and back sections;

wherein the cover section includes inside and outside cover face surfaces;

wherein the back section includes inside and outside back face surfaces;

wherein the holder includes a sound recording receiving pocket on one of the inside cover, inside back, or outside back face surfaces and overlapping part of the surface area occupied by the one face surface;

greeting indicia on the outside cover face surface; and message indicia on a prescribed one of the inside cover face surface, inside back face surface, or pocket.

10. A personalized, user assembled greeting card including:

a manually usable holder for detachably receiving a sound recording selected by a card giver from a variety of available sound recordings, and for holding the selected sound recording for manual detachment by a recipient of the personalized, user assembled greeting card a card body including cover and back sections, and a fold separating the cover and back sections;

wherein the cover section includes inside and outside cover face surfaces;

wherein the back section includes inside and outside back face surfaces;

wherein the holder includes a sound recording receiving pocket on the inside back surface and overlapping part of the surface area occupied by the inside back surface.

11. A personalized, user assembled greeting card including:

a manually usable holder for detachably receiving a sound recording selected by a card giver from a variety of available sound recordings, and for holding the selected sound recording for manual detachment by a recipient of the personalized, user assembled greeting card a card body including cover and back sections, and a fold separating the cover and back sections;

wherein the back section includes inside and outside back face surfaces;

wherein the holder is integral with the back section and is folded and formed to define a sound recording receiving pocket on the inside back surface and overlapping part of the surface area occupied by the inside back surface.

12. A personalized, user assembled greeting card including:

a manually usable holder for detachably receiving a sound recording selected by a card giver from a variety of available sound recordings, and for holding the selected sound recording for manual detachment by a recipient of the personalized, user assembled greeting card wherein the holder includes a sound recording receiving pocket including a flat panel with peripheral edge surfaces and having flanges on some of the edge surfaces attached to the card body and spacing the panel from the card body by a distance to enable the sound recording to be releasably received between the panel and card body; and wherein the sound recording pocket is shaped such that the panel will partially cover a sound recording received within the pocket and leave a portion of the sound recording visible.

13. A process for dispensing greeting cards and sound recordings for user assembly in a combination to present a personalized, greeting card with a sound recording to a recipient, comprising the steps of:

providing a selection of greeting cards, each card being capable of carrying a sound recording; and providing a selection of sound recordings, each being capable of being carried by a selected one of the greeting cards and capable of user assembly with the greeting cards.

14. A process for assembling greeting cards with sound recordings as claimed by claim 12, comprising the further steps of:

selecting a greeting card from the selection of greeting cards;

selecting a sound recording from the selection of sound recordings; and combining the selected sound recording with the selected greeting card to produce a personalized greeting and sound recording combination.

* * * * *